United States Patent [19]

Fishel

[11] Patent Number: 4,494,442

[45] Date of Patent: Jan. 22, 1985

[54] VALVE ACCENTUATION MECHANISM FOR OPPOSED INVERTED V ENGINE

[76] Inventor: Clark N. Fishel, 6704 Shady Cedar Cir., Austin, Tex. 78734

[21] Appl. No.: 363,569

[22] Filed: Mar. 30, 1982

Related U.S. Application Data

[63] Continuation of Ser. No. 152,768, May 23, 1980, abandoned.

[51] Int. Cl.[3] ..... F01B 7/04

[52] U.S. Cl. ..... 91/181; 91/188; 92/69 R; 137/625.67

[58] Field of Search ..... 91/188, 181; 92/69; 137/625.67

[56] References Cited

U.S. PATENT DOCUMENTS

| | | | |
|---|---|---|---|
| 668,058 | 2/1901 | Shaw | 91/181 |
| 2,115,556 | 4/1938 | Maniscalco | 91/188 |
| 2,507,923 | 5/1950 | Morris | 92/69 R |
| 2,584,659 | 2/1952 | Audemer et al. | 91/188 |
| 4,094,227 | 6/1978 | King | 92/69 R |

FOREIGN PATENT DOCUMENTS

| | | | |
|---|---|---|---|
| 2839561 | 3/1979 | Fed. Rep. of Germany | 91/188 |
| 939763 | 4/1948 | France | 91/188 |
| 652364 | 3/1979 | U.S.S.R. | 91/188 |

*Primary Examiner*—Paul E. Maslousky

*Attorney, Agent, or Firm*—Arnold, White & Durkee

[57] ABSTRACT

A valving mechanism for use in machines such as internal combustion engines, steam engines, gas compression engines or air compressors. The mechanism employs a piston valve reciprocating within a cylindrical chamber under the direct action of cam surfaces carried upon a gear-driven flywheel. The cylindrical valve chamber carries a plurality of spaced apart ports, which are interconnected with the cylinder of the machine and with intake and exhaust systems. The machine has a piston reciprocated within the cylinder by means of a crank shaft which carries a crank shaft gear which interconnects with and drives the flywheel gear. One side of the flywheel gear carries cam surfaces which move the piston valve between the several positions required during the compression and exhaust and intake cycles of the machine. The valve chamber is mounted, transversed to the cylinder and in parallel with the crank shaft. With this arrangement of valving mechanism, the machine can be made very compact and simplified in numbers of operative elements while the unique piston valving provides improved valve timing and volumetric efficiency for the machine.

15 Claims, 14 Drawing Figures

FIG. 1
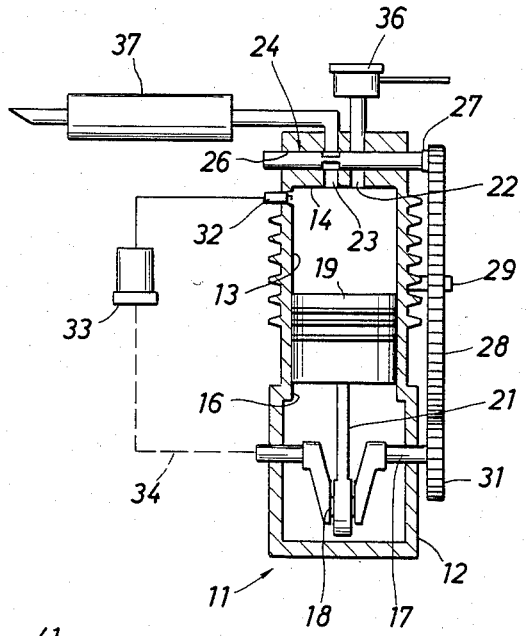
FIG. 4A
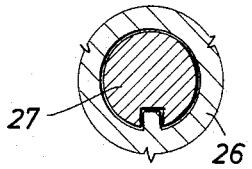
FIG. 3
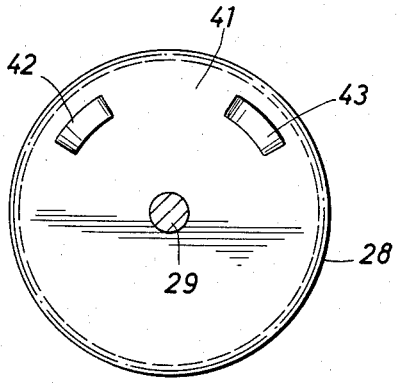
FIG. 2
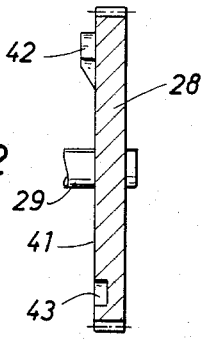
FIG. 4
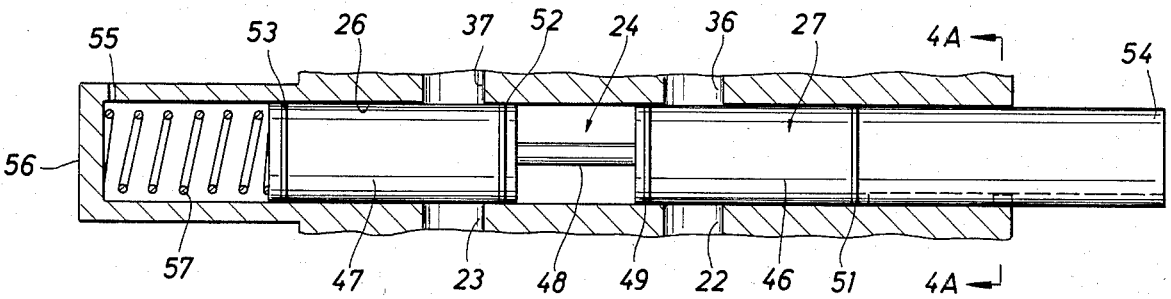
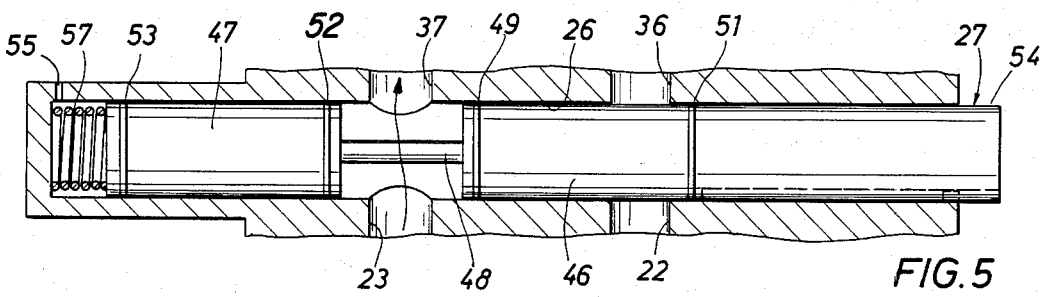
FIG. 5

FIG. 6
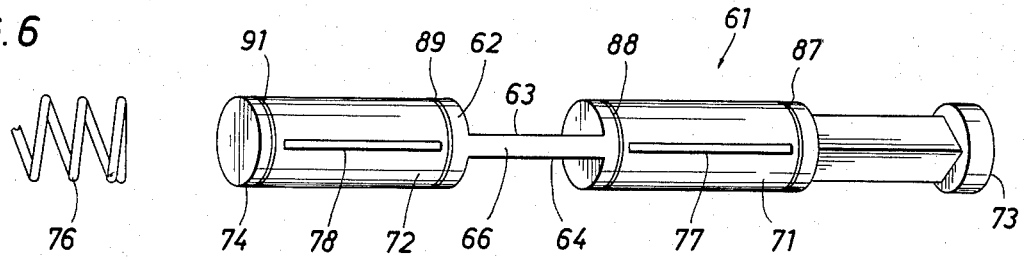
FIG. 7
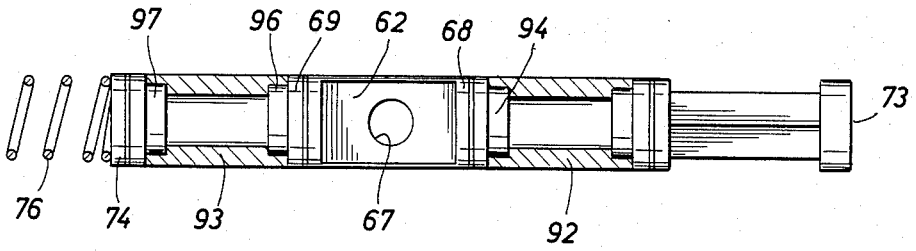
FIG. 8
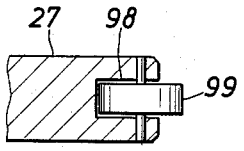
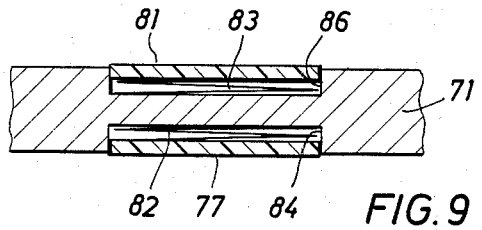
FIG. 9
FIG. 10
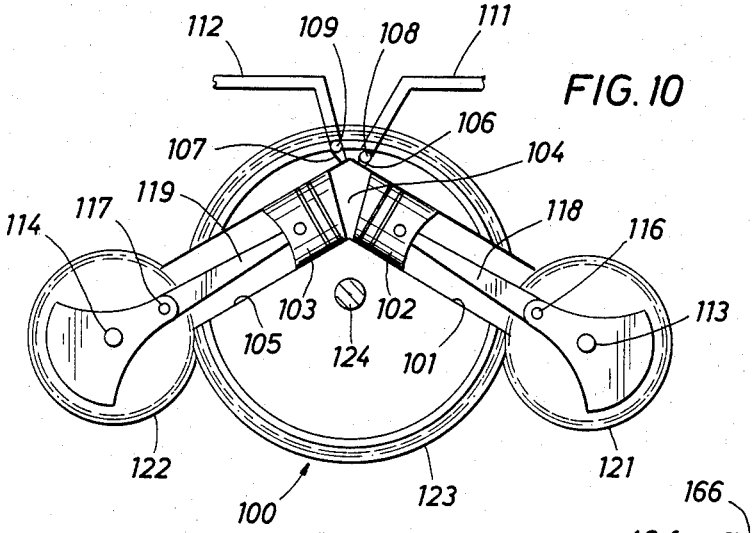
FIG. 11
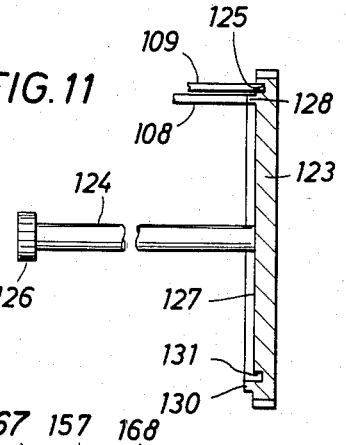
FIG. 13
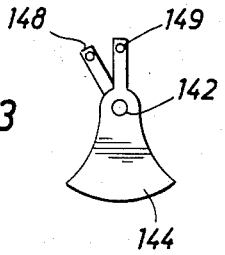
FIG. 12
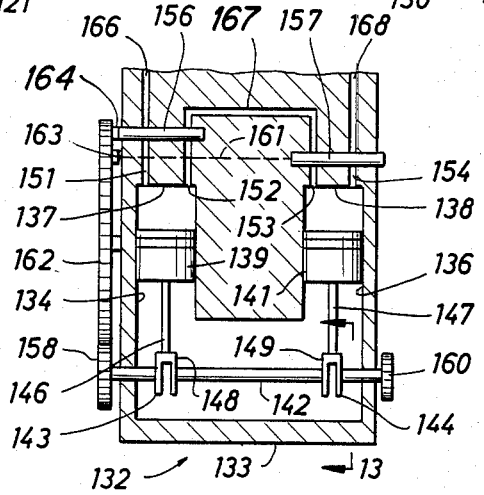

VALVE ACCENTUATION MECHANISM FOR OPPOSED INVERTED V ENGINE

This is a continuation of application Ser. No. 152,768, filed May 23, 1980, now abandoned.

BACKGROUND OF THE INVENTION

1. Field of the Invention

This invention relates to machines employing reciprocating pistons within cylinders, such as internal combustion engines, and more particularly, it relates to an improved valving mechanism for use in such machines.

2. Description of the Prior Art

The prior art is replete with numerous examples of machines which employ a piston reciprocated within the cylinder and a valve mechanism to provide for the intake, compression, power and exhaust cycles. Generally, the valving mechanism employed either a disc valve or a cylindrical type of valve, such as the sleeve valve. The sleeve valve or cylinder type of valve in general, had a cylindrical piston or the like, which was reciprocated within a valve chamber to cover and uncover various ports to the intake and exhaust systems employed with the machine. Reference may be taken, to the following U.S. Pat. Nos. for examples of these types of cylinder or sliding piston types of valving: 1,189,660; 1,314,457; 1,587,152 and 1,756,648.

In general, the operation of the cylindrical or piston valving was accomplished by employing push rods, or the like, which were driven through some connection to the crank shaft. Generally, a gear drive arrangement was made through a push rod, which either moved axially or was rotated, and through an appropriate connection to the valving so that the piston or cylindrical valve member was reciprocated within its chamber. As a result, these machines required a great complexity in numbers of components to drive the relatively simple valving mechanism.

The piston valving mechanism found in the prior art, generally, provided satisfactory results and could be employed with the same utility as the disc valving found in more conventional machines such as the present day automobile engine. However, the operation of this valving required such additional components and space, that a very compact and simple machine was difficult to build. For example, in the U.S. Pat. No. 1,976,286, there is shown an engine having opposed cylinders such as employed in a compact design, but the valving employing the piston or cylindrical slide valve mechanism. The valving could be driven only by external rocker arms and push rods which greatly increased the size of the machine and its complexity through the use of an additional set of elements. Similar engines are shown in U.S. Pat. No. 1,991,218 and 1,077,956. Although, these early patents show several valving systems employing the piston or cylindrical sliding valve, their combination into the machine left much to be desired from simplicity of operation and especially, compactness. In addition, these valving mechanisms also do not provide the optimum in improved valved timing and volumetric efficiency for the overall machine.

SUMMARY OF THE INVENTION

In accordance with this invention, there is provided in a machine, such as an internal combustion engine, a steam engine, a gas engine or an air compressor, an improved valve accentuation mechanism of unique design in arrangement. The machine has at least one cylinder closed at one of its ends, and a piston mounted on a crank shaft for reciprocation within each cylinder from its open end, and a crank shaft gear mounted upon the crank shaft. The improved valving mechanism consists of a cylindrical valve chamber mounted adjacent the closed end of the cylinder. The chamber is mounted transverse to the cylinder and in parallel to the crank shaft. The chamber interconnects the cylinder by spaced apart ports with intake and exhaust systems.

A cylindrical piston valve is mounted for sliding movement within the valve chamber and has an opening selectively to interconnect the ports with the intake and exhaust means at several longitudinal positions. A flywheel gear is journaled to the body of the machine and rotates about an axis parallel to the crankshaft. The flywheel gear is driven by engagement with the crankshaft gear. The flywheel gear carries on one of its sides, cam surfaces which are adapted to move the piston valve axially at selected angular positions of the flywheel gear between the several positions correlated to reciprocation of the piston within the cylinder of the machine. As a result, the flywheel gear directly drives the piston valve within the cylindrical valve chamber and thereby, selectively controls the flow through the ports of the valve chamber in timed sequence relative to rotation of the crank shaft.

With this arrangement of the present invention, the flywheel gear may be arranged with cam surfaces to provide in the machine the function of an internal combustion engine, a steam engine, a gas engine or an air compressor. In addition, other advantageous arrangements of these cam surfaces may be provided to improve valve timing, volumetric efficiency and compactness of the resultant machine.

DESCRIPTION OF THE DRAWINGS

FIG. 1 is a pictorial cross-sectional view of a simple one cylinder machine employing the unique valve accentuating mechanism of this invention;

FIG. 2 is a partial cross-section of the flywheel gear in enlargement as shown in FIG. 1, but illustrating cam surfaces employed for actuating the sliding piston valve;

FIG. 3 is a side view of the flywheel gear taken from the engine side illustrating the placement of the exhaust and intake cam surfaces;

FIG. 4 is a longitudinal cross-section of the valving assembly of the machine shown in FIG. 1;

FIG. 4A is a cross-sectional view at one end of the piston valve;

FIG. 5 is a partial cross-sectional view as seen in FIG. 4, but with the piston valve moved so as to interconnect the exhaust system to the exhaust port of the machine shown in FIG. 1;

FIG. 6 is a prespective view in partial disassembly showing another embodiment of a piston valve of the type employed in the valving mechanism of the machine in FIG. 1;

FIG. 7 is a cross-sectional view taken longitudinally through the second embodiment of the piston valve shown in FIG. 6;

FIG. 8 is a partial view taken at one end of the piston valve illustrating a roller arrangement employed for a reduced friction engagement of the cam surfaces carried upon the flywheel gear;

FIG. 9 is a partial enlarged longitudinal cross-section showing the arrangement of longitudinal seals employed with the sliding piston valve, such as shown in FIG. 6;

FIG. 10 is an illustrative cross-section showing the use of the unique sliding valve mechanism of the present invention in association with a compact design of counter opposed piston machinery;

FIG. 11 is a cross-sectional view of the flywheel gear and cam surfaces employed for operating the valving mechanism of the machine shown in FIG. 10;

FIG. 12 is an illustrative cross-section of a two stage compound type of a machine, in the nature of a steam engine or air compressor employing the sliding piston valving mechanism of this invention; and, FIG. 13 is a cross-sectional view taken along line 13—13 of the machine shown in FIG. 12, and illustrating the staggered crank pin arrangement employed on the compound machine shown in FIG. 12.

DESCRIPTION OF PREFERRED EMBODIMENTS

Referring to FIG. 1, a simple one cylinder machine is shown in which the engine uses the unique slide piston valving of this invention. The engine 11 has a body 12 carrying a cylinder 13 having a closed end 14 and an open end 16. A crankshaft 17 is journaled within body 12 and carries an offset crank pin 18. A piston 19 is mounted for reciprocation within cylinder 13 and is interconnected by a crank rod 21 to the crank pin 18. As a result, rotation of crank shaft 17 provides output power as the piston 19 reciprocates within the cylinder of machine 11. The body 12 at the closed end 14 of the cylinder is provided with intake and exhaust openings 22 and 23 respectively. The unique valving mechanism 24 of the present invention is mounted transversely to cylinder 13 and in parallel to crank shaft 17, immediately adjacent the intake and exhaust openings on the machine.

As seen in FIG. 4, valving mechanism 24 comprises a cylindrical valve chamber 26 in which is mounted for axial movement a sliding cylindrical piston valve 27. The cylindrical valve chamber is mounted transverse to cylinder 13, but is in parallel to crank shaft 17. One end of piston valve 27 projects from valve chamber 26 and is held in contact with the side face of a flywheel 28 which is journaled to body 12. The flywheel 28 may be journaled to body 12 by a short jack shaft 29 that is parallel to shaft 17. The crank shaft 17 carries a crank shaft gear 31 which is engaged with gear teeth on the flywheel 28 and drives same directly so as to reflect rotation of crank shaft 17. If desired, the flywheel 28 may be rotated synchronously by any rotary means reflecting reciprocation of the piston 19.

Referring specifically to FIGS. 2 and 3, flywheel 28 carries on one face, preferably the face presented towards body 12, a plurality of cam surfaces which are arranged to move axially piston valve 27 within valve chamber 26. These surfaces and their function will be described hereinafter in more detail. The purposes of these surfaces are to operate the novel valving mechanism of this invention in precise valve timing to the reciprocation of piston 19 within cylinder 13 of machine 11.

The machine 11 may be of a suitable nature employing intake, compression, power and exhaust cycles in the form of an internal combustion engine, a steam engine, a gas engine or an air compressor or the like. For illustration in FIG. 1, machine 11 will be considered to be a gasoline powered, internal combustion engine. For this purpose, cylinder 13 is provided with a spark plug 32 which receives high tension voltage from an ignition system 33 and interconnected to crank shaft 17 by a timing connection illustrated by the chain line 34. In addition, valving mechanism 24 has a inlet port connected between cylinder 13 and a carburation or fuel injection system 36, which provides a conventional device for mixing fuel and air into the necessary proportions and volumes for operating the machine.

Also, valving mechanism 24 carries exhaust ports which interconnect cylinder 13 with an exhaust system which may be an exhaust pipe and muffler combination 37. With this arrangement, the crank shaft rotation is translated by flywheel 28 to produce a synchronous sliding movement of piston valve 27 within valve chamber 26 so as to selectively interconnect the inlet and exhaust ports between cylinder 13, carburation device 36 and exhaust system 37.

It will be apparent, that the novel valve mechanism 24 of the present invention is mounted directly adjacent closed end 14 of cylinder 13. If desired, the cylindrical valve chamber 26 may be made intergral with the closed end 14 of body 12. Preferably, the valve mechanism 24 is made to interconnect by bolting or the like with closed end 14 of cylinder 13. Other arrangements for mounting valving mechanism 24 to machine 11 will be apparent as the description progresses.

The construction of flywheel 28 can be seen in more detail in FIGS. 2 and 3. The inside face 41 is provided with cam surfaces 42 and 43. The cam surface 42 and 43 are so arranged that as the end of piston valve 27 rides over them, the valve is moved to its proper longitudinal position within cylindrical chamber 26 and alternately connect and seal the exhaust and intake openings to cylinder 13. More particularly, cam surface 42 is a raised projection having a gently increasing slope to a maximum width and then decreasing gently back to the inside face 41. In like manner, cam surface 43 is a recess formed on face 41 having the gentle leading edge to its maximum depth and then a gentle slope carrying the recess back to the face 41. Thus, flywheel 28 by the cam surfaces 42 and 43, directly operates piston valve 27. There are no required intermediate push rods or like operating shifting rods as in the prior art machines. In addition, the advantages of such an arrangement are that the cam surfaces may be provided with any desired timing and longitudinal shifting of piston valve 27.

The valve 27 is usually left free to rotate within the chamber 26. However, the valve 27 can be keyed by a pin and slot arrangement into a non-rotating but longitudinal sliding mounting in chamber 26 as shown in FIG. 4A. Other keyed arrangements may be used such as non-round (square cross-sections) as illustrated in FIGS. 6 and 7.

The sliding port or window valve mechanism 24 has a greater venturi area when open, than a standard poppet valve. The sliding port or window valve can therefore inlet and exhaust a greater volume of gases. The sliding port valve requires less spring tension than a poppet valve because it does not require a spring for actual maintenance of seal efficiency, but merely uses the spring as a tensioner to maintain contact with the flywheel. No tappets, push rods, rocker arms and poppet valves of the conventional engine are required by the sliding port valve. The sliding port or window valve requires no specialized tools or mechanic training and it can be maintained by mechanics versed in the currently popular powerplants. The sliding port or window valve can be readily adapted for use in both gasoline or diesel engines.

The sliding port valve can be easily removed or replaced. In its intended use, the removal of a cam wheel cover followed by the removal of the flywheel provides easy removal of the sliding port valve whereby both intake and exhaust ports can then be inspected and if desired, sealing rings replaced. Compare these features to the conventional poppet valve where the heads, the intake and the exhaust manifolds must be removed and the heads sent to a machine shop for reseating. If you need to check the cam condition in the conventional engine, major disassembly is required.

The ease of maintenance alone should make the present slide valve a very popular arrangement with both the consumer and the mechanic. The sliding port valve should also outlast the conventional poppet valve just as rings outlast valves in standard engines today. Therefore, the advantages of the sliding port or window valve include greater efficiency with less moving parts, easier maintenance and low manufacturing costs.

The piston valve may be made with close tolerances so as to seal against fluid escape from the inlet and outlet ports. However, it is preferred to place replaceable seal members about the piston valve.

For this purpose, annular grooves are provided the piston valve 27 and ring seals 49, 51, 52 and 53 are mounted in these grooves. These seals provide a fluid-tight, sliding seal between chamber 26 and valve 27. The seals may be of conventional construction, such as formed from Teflon, steel, plastic or carbon.

The construction of slide valve mechanism 24 is shown in more detail in FIG. 4. The valving mechanism has a cylindrical valve chamber 26 which has an interior surface of a suitable finish so as to receive cylindrical piston valve 27 for easy and relatively friction-free axial movement between several longitudinal positions. For this purpose, the interior surface of valve chamber 26 may be honed to relatively smooth and finely polished cylindrical configuration. The piston valve 27 may be constructed from two cylindrical members 46 and 47, which are interconnected by a spacer rod 48.

The members 46 and 47 may be only slightly smaller than the internal diameter of valve chamber 26. The rod 48 may be threadedly connected to members 46 and 47 or may be machined otherwise, or intergrally secured to them. As a result, it will be seen that spacer rod 48 provides an open area within the center of piston rod 27.

Preferably, fluid seals are provided on piston valve 27 so as to provide a fluid type seal between piston valve 27 and the internal cylindrical surface of valve chamber 26. For example, there may be provided a pair of seals 49 and 51 on members 46 and a pair of seals 52 and 53 on member 47. These seals may take any desired form and configuration, but preferably, these seals are adapted to stand the environment during operation of machine 11. For example, these seals may be the typical metal rings such as used to seal piston 19 to cylinder 13, but of a smaller diameter. If desired, seals of a synthetic material, such as Teflon, may be employed to seal piston valve 27 to valve chamber 26.

With this arrangement, piston valve 27 in the central longitudinal position provides a pressure seal between the intake and exhaust ports. Fluid leakage can not occur internally within valve chamber 26 because of the several seals carried upon piston valve 27.

The piston valve 27 carries on one end a hardened surface follower 54 which is adapted to ride upon the cam surfaces 42 and 43 during rotation of flywheel 28. The other end of piston valve 27 is adjacent an enclosing end 56 of valve chamber 26. A vent 55 provides a compression release for the end 56. A spring 57 provides for urging piston valve 27 to the right and to maintain the follower surface 54 in engagement with face 41 and cam surfaces 42 and 43. As a result, during the rotation of flywheel 28, the face 41 will maintain piston valve 27 in its central longitudinal position where both the intake and exhaust ports are sealed from the cylinder 13. When cam surface 42 is encountered by the follower surface 54, piston valve 27 will be moved to the left to its second position longitudinally within the valve chamber 26. This position is seen in FIGS. 1 and 5.

In this position of piston valve 27, the open area containing spacer rod 48 is positioned in alignment with the exhaust ports of valve chamber 26. As a result, the exhaust opening 23 of cylinder 13 is connected through this open area into the exhaust system 37. Thus, high pressure gasses can be discharged readily from cylinder 13 by an uprising piston 19. It will be apparent, that as the cam surface 42 is rotated away from cam follower 54, the piston valve 27 is returned to the central longitudinal position as is shown in FIG. 4. Continuing with the rotation of flywheel 28, piston valve 27 is moved by spring 57 to the right into the cam surface 43 to the third longitudinal position where the open area provided about spacer rod 48 is an alignment with the intake ports. As a result, at this position, intake opening 22 is connected to the carburation device 36 and a downward movement of the piston 19 draws a combustible mixture into the upper end of cylinder 13.

It will also be apparent, that the positioning and extent of cam surfaces 42 and 43 can be arranged according to proper valve timing to provide the desired four cycle system of intake, compression, power and exhaust cycles. If desired, it will also be apparent that the internal combustion engine provided by the machine 11 may be converted with suitable changes of the device into a diesel type engine where only the high compression conditions of cylinder 13 caused by an uprising piston 19 are needed to ignite the combustible mixture. Otherwise, this system would work in its explained fashion.

It will be apparent that machine 11 can also be used as a gas engine by merely replacing carburation device 36 by high pressure gas and it can be converted readily into a steam engine or a gas engine. If desired, machine 11 can be operated as an air compressor by omitting carburation device 36 and the exhaust pipe and muffler combination 37 and interconnecting the exhaust ports with a check valve and storage tank. Then, crank shaft 17 is driven from an external power source and the system operates in a conventional manner as would an air compressor where the reciprocation of piston 19 within chamber 13 causes a discharge of high pressure gas into the storage vessel.

An improved type of piston valve for use in valve chamber 26 is shown in FIGS. 6 and 7. In this construction, the metal piston valve 61 has a central cylindrical spacer 62 carrying longitudinal recesses 63 and 64 leaving an intermediate flat web 66. The web 66 is provided with a relatively large window or opening 67 centered within the web 66. Integrally connected to ends 68 and 69 of spacer 62 are cylindrical end portions 71 and 72. For example, the cylindrical end portions may be welded to the spacer 62. The portion 71 may be provided with an end face of a hardened cam follower 73. The end of portion 72 may be provided with a recessed cup like member 74 to receive a spring 76 which is used for returning the piston valve to the right as viewed in the drawings.

A particular advantage of the construction of piston valve 61 is through the use of longitudinally extending seals. These seals are mounted on each side of the valve 61 and diametrically opposite one another on both end portions 71 and 72. The seals 77, 78 and 81 are aligned with web 66 and can be seen in their positioning in the side surfaces of portions 71 and 72. The longitudinal seal opposite seal 78 on the portion 72 is not shown on the drawings.

Referring momentarily to FIG. 9, there is shown a portion of cylindrical portion 71 which carries on one side the seal 77 and diametrically opposite therein, carries the second seal 81. These seals may be rectangular segments of a sealing material, such as Teflon mounted upon leaf springs 82 and 83 within rectangular openings 84 and 86 formed in the side surfaces of member 71.

These longitudinal seals should be of a longitudinal dimension to extend between the encircling seals 87 and 88 on portion 71 and encircling seals 89 and 91 on portion 72. These encircling seals may take the same configuration as has been described for seals 49, 51, 52 and 53 used upon piston valve 27. As a result, the encircling seals prevent undesired fluid movement axially along piston valve 61, whereas the longitudinal seals form a transverse seal against fluid loss directly between the intake and exhaust ports on valve chamber 26. Thus, when piston valve 61 is in the central position, seals 88 and 89 maintain fluid-tight sealing so that bypass flow between the intake and exhaust ports in valve chamber 26 cannot occur. When piston valve 61 is in the longitudinal left or right positions, the longitudinal seals prevent transverse fluid flow between the closed intake or exhaust ports of valve chamber 26, as the case may be.

If desired, piston valve 61 may be formed out of tubular members 92 and 93 for portions 71 and 72. For this purpose, each tubular member 92 and 93 is secured to the end face of cylindrical spacer 62 about a projection 94 and 96, respectively. These tubular members 92 and 93 may be secured by welding or other integrally connecting means. The follower 73 may be formed of like configuration and welded to the end of the tubular member 92. The cup end 74 may be formed at the end of tubular member 93 by an internal spacer 97. Other means of constructing the piston valve 61 may be employed, if desired.

The hardened cam followers 54 and 73 as used with piston valves 27 and 61, may be replaced by a reduced friction roller assembly as is shown in FIG. 8. For example, piston rod 27 has at its end, adjacent flywheel 28, a slot 98 in which is journaled a roller 99. The roller 99 is adapted to travel upon the face 41 of flywheel 28. With this arrangement, a relatively low friction interconnection between the piston valve and face 41 of flywheel gear 28 is accomplished.

It will be apparent that the piston valves and cylindrical valve chambers may be so arranged as to provide a plurality of ports which are interconnected by a plurality of open areas within the piston valve. For example, two piston valves may be operated in the same valve chamber so that a plurality of exhaust and intake ports may be controlled through longitudinal movement of the piston valve or valves therein. Other arrangements may also be made wherein a plurality of piston valves control several intake ports and another set of piston valves control a plurality of exhaust ports, and all the piston valves are articulated from the flywheel. As a result, the present valving mechanism can be employed with multi-cylinder engines and arranged to provide in a desired piston valve arrangement any desired valving sequence in timing, aspiration and the like.

An example of such an arrangement is shown in FIG. 10 an inverted Vee internal combustion engine 100. In this engine there is shown a body having counter opposed cylinders 101 and 105 in which are reciprocated a pair of pistons 102 and 103. The angle between these cylinders is between 80 degrees and 179 degrees, but preferably about 120 degrees. The pistons have a common compression zone 104 between their inclined top surfaces. The compression zone 104 is connected by an inlet port 106 and an outlet port 107 to slide valving mechanism 108 and slide valving mechanism 109 respectively. The valving mechanisms 108 and 109 may take the form of valve piston 27 and cylindrical or valve chamber 26 for interconnection respectively to an inlet system 111 and an exhaust system 112. Additional pairs of cylinders can be added to the engine 100 and the valving mechanisms 108 and 109 can be repeated, or made with multi-piston valves in this arrangement.

For example, the machine 100 may be a diesel engine which employs high compression conditions for igniting a fuel mixture injected through the inlet system 111. For this purpose, pistons 102 and 103 are reciprocated by means of crank elements 113 and 114 which carry crank pins 116 and 117. The crank pins 116 and 117 operatively connect to the pistons by means of crank rods 118 and 119. Each of the crank elements 113 and 114 carry a peripheral gear surface 121 and 122 respectively, which surfaces engage a central flywheel gear 123 that is journaled to the body in which are formed cylinders 101 and 105. The flywheel gear 123 is rotated in precise time sequence to the rotation of crank elements 113 and 114. As a result, the movements of the pistons are correctly synchronized as they reciprocate within cylinders 101 and 105 relative to the valving mechanisms. The flywheel gear 123 is provided with cam surfaces of the same nature as flywheel 28 which was employed within the machine 12 shown in FIGS. 1, 2 and 3.

The cam surfaces reciprocate the piston valves within the valving mechanisms 108 and 109 associated with the intake and exhaust systems of machine 100. In FIG. 11, there is shown flywheel gear 123 carried upon a center shaft 124, and the shaft is journaled adjacent combustion zone 104 upon the body of machine 100. The shaft 124 extends the length of the engine 100 and provides power output by means of a coupling 126 carried at its end. The peripheral surface of flywheel gear 123 carries suitable teeth members and has an inside surface 127 on which the necessary cam surfaces are provided. For example, there is a raised cam surface 130 and a recessed cam surface 131 which engages the end 128 of the piston valve associated with valving mechanism 108. A recessed cam surface 131 and a raised cam surface 130 engage the end 125 of the piston valve associated with the valving mechanism 109. The cam surfaces 127, 130 and 131 are adjacent the periphery of flywheel 123 and operate in the same manner as was described for cam surfaces 42 and 43 of machine 11. It will be apparent by viewing FIGS. 10 and 11, that the arrangement of a counter-opposed, piston-type, inverted V diesel engine employing the present invention can be made most compact and with a very minimum of operative elements. This may be seen by ready comparison through the complicated structures employed in the prior art.

Advantages of the opposed inverted V engine include greater volumetric efficiency due to two pistons meeting in a common cylinder. Ability to run on lower octane fuels due to increased compression effects created by two pistons with a common compression chamber. Increased utilization of burned gases arises from two pistons turning two crankshafts from a single power impulse. Readily adaptable of this engine, to steam, diesel, gas or a air compressor function. No head or head gasket exists and head gasket failure is avoided. This engine can be repaired by mechanics trained in current engine repair without special tools for repair. No massive retooling for manufacture of this engine is required. Less moving parts in the valve train and greater ease in removing them. The engine is very compact with two cylinders providing the power of four and it has a low profile. The opposed engine shows great promise in stationary use, especially as a compound system engine. It can be mounted transversely for use in front wheel drive cars. In summary, this unique engine provides simplicity of operation using basic principles and should be easily understandable by consumer and mechanic.

The present invention may be employed with compounded engines such as a two-stage, compounding steam engine. One such example is shown in FIG. 12. A two cylinder steam engine 132 is shown, wherein exhaust of one cylinder is applied to the intake of a second cylinder with the actions of the cylinders being controlled by a pair of valve mechanisms arranged according to the present invention as described in FIGS. 4 and 5. More particularly, the steam engine 132 has a body 133 containing two parallel oriented cylinders 134 and 136. The cylinders are closed by cylinder heads 137 and 138. A pair of pistons 139 and 141, respectively, reciprocate within cylinders 134 and 136. These pistons are carried upon a common crank shaft 142 which has a pair of crank members 143 and 144. The crank members may have the usual counterbalanced portions which counterbalance the mounting of the pistons through connecting rods 146 and 147 to crank pins 148 and 149.

The cylinder 134 has inlet and outlet ports 151 and 152 within cylinder head 137. In like fashion, cylinder 136 has inlet and outlet ports 153 and 154 respectively, formed within the cylinder head 138. In addition, a valving mechanism 156, arranged according to the present invention and which may take the form as was described for machine 11, is provided for cylinder 134 and another valving mechanism 157 of like construction is provided for cylinder 136. As was employed in the previous described machines, the crankshaft gear 158 drives flywheel gear 162 in synchronism.

The flywheel gear 162 carries the cam surfaces necessary to provide the proper valve action for valving mechanisms 156 and 157, as was described for flywheel gear 28 and associated with machine 11. The valving mechanism 157 is extended as indicated by chain line 161 through the head 137 into contact with these cam surfaces. More particularly, this valving is arranged so that the exhaust from cylinder 134 is passed through the conduit 167 to the intake 153 of cylinder 136 on its intake cycle. For this purpose, steam is admitted through inlet 166 to reciprocate piston 139 in cyinder 134. Then, piston 139, on its upward exhaust stroke, will force the steam through exhaust opening 152, valving mechanism 156, an interconnecting pipe 167, the inlet port of valving mechanism 157, and then into inlet port 153 of cylinder 136. The rising piston 141 in cylinder 136 during the exhaust cycle will discharge the steam to an exhaust system 168 either for recovery or heat conservation purposes. The cam surface 163 on gear 162 is so arranged that the timing of valving mechanisms 156 and 157 provide for this two-stage compounding action. In particular, crank shaft 142 uses a staggered crank pin arrangement which may be seen in FIG. 13.

Crank shaft 142 may carry the usual counterbalance members 143 and 144 and has crank pin 148 offset approximately 15° from crank pin 149. Thus, the power stroke in cylinder 136 is timed approximately 15° in advance of the intake stroke on cylinder 136. Thus, the cam surfaces on flywheel gear 162 are so timed to provide the optimum action in valving mechanisms 156 and 157 for this particular result.

Stated in another manner, valving mechanism 156 will provide exhaust steam from cylinder 134 approximately 15° later than the intake movement of the piston in the cylinder 136. This precise valve timing allows a more complete and efficient utilization of two-stage steam engine operation.

The valving mechanisms of the present invention are a particular kind of a unique sliding piston valve arrangement which is capable of being used with a variety of intake and exhaust port arrangements. In particular, the flow through the valving mechanism employs very large areas and relatively small pressure drops, and uses seals which are long-lasting since they are only in axial movement and easily replaced. In particular, the use of longitudinally oriented seals in the side surfaces of the piston valve provides better sealing between the inlet and exhaust ports and does not require complicated seal structures. In addition, it is relatively easy to change the valve timing for a given machine by merely changing the flywheel gear with its associated cam surfaces.

For example, a steam engine can be readily converted to an air compressor. In addition, the simple change in valve timing can produce an optimized functioning compound engine. Most importantly, the use of the direct action of the operation of the piston valves from side surface cams upon the flywheel gear enables the constructor to make a very compact and simple machine of a desired utility in internal combustion, steam, gas or air compressor utilization.

In particular, the flywheel gear is a relatively large surface on which the cams may be provided. With such a large side surface, the oncoming and offgoing ramp slopes and the particular displacement width of the cams are readily obtained. In addition, a simple change of these surfaces can be provided to change the valve timing for any desired mode of operation. Other modifications of these cam surfaces will be apparent to those skilled in the art.

From the foregoing, it will be apparent that there has been provided in a machine a unique type of valving mechanism employing a cylindrical or piston valve assembly. This valving mechanism is readily operated without the use of several elements normally employed with conventional valve systems, such as push rods, hydraulic lifters, rocker arms or the like. It will be understood that certain changes or alterations in the present improvement in machines may be employed without departing from the spirit of this invention. These changes are contemplated by and are within the scope of the appended claims which define the invention. Additionally, the present description is intended to be taken as an illustration of this invention.

What is claimed is:

1. In a machine, such as an engine or an air compressor, the improvement comprising:

(a) a body supporting a pair of counter-opposed cylinders whose axes are oriented in an intersecting angle between 80 and 179 degrees and each pair of said cylinders having a common compression zone;

(b) means mounting a piston for reciprocation within each cylinder from its open end;

(c) rotary means connected with said pistons reciprocating in said cylinders;

(d) a flywheel journaled to said body for rotation about an axis and driven by said rotary means;

(e) a plurality of cylindrical valve chambers mounted on said body parallel to said flywheel axis of rotation;

(f) said valve chambers being connected to said compression zone of each cylinder pair by spaced apart ports, with one valve chamber being connected to intake means and the other valve chamber being connected to exhaust means;

(g) cylindrical piston valves mounted for axial movement within said valve chambers and having valve openings selectively aligned to interconnect said ports of said valve chambers with said intake and exhaust means; and (h) said flywheel carrying cam surfaces adapted to move axially said piston valves to preset positions within said valve chamber at selected angular positions of said flywheel whereby said piston valves are moved between preset positions and control flow through said ports in said valve chambers in timed sequence to reciprocation of said pistons in said cylinders.

2. The machine of claim 1, wherein separate valve chambers are employed with each pair of said cylinders for interconnection by said ports to said intake and exhaust means.

3. The machine of claim 1, wherein said cylinders are aligned into an inverted Vee of about 120 degrees with said flywheel being journaled adjacent the common compression zone and within the intersection of said cylinders, and said cylindrical valve chambers are positioned radially outwardly from said common compression zone with the valve pistons being articulated by cam surfaces carried on the side surface of said flywheel adjacent its periphery.

4. A machine including a body having at least one machine cylinder, a piston mounted for reciprocal movement in each machine cylinder, intake and exhaust means for each machine cylinder, and a valve mechanism for controlling flow between the intake and exhaust means and each machine cylinder, each valve mechanism comprising:

(a) A cylindrical valve chamber having spaced intake and exhaust ports for connecting the intake and exhaust means to the machine cylinder;

(b) At least one piston valve mounted for axial displacement within the valve chamber, each piston valve having an opening for selectively connecting the ports with the intake and exhaust means, and each piston valve having a cam follower portion;

(c) Means to prevent rotation of each piston valve about its axis;

(d) A flywheel to be rotatably driven by rotary means operatively connected to the piston;

(e) Cam surfaces provided on the flywheel for cooperating directly with the cam follower portion of each piston valve to displace each piston valve axially during rotation of the flywheel to thereby selectively control flow through the ports in timed sequence relatively to reciprocation of the piston in the machine cylinder;

(f) Means to urge each piston valve axially for the cam follower portion to maintain cooperation with the cam surfaces during use; and (g) Longitudinal seal means operative between each piston valve and the valve chamber to limit flow between at least one of the intake or exhaust means and its associated port when the opening of the piston valve is out of register therewith, the longitudinal seal means comprising, for each piston valve, a pair of longitudinal fluid seals which are provided on the piston valve in an opposed pair on at least one side of the opening of the piston valve.

5. A machine according to claim 4, in which the longitudinal seal means comprises a plurality of longitudinal fluid seals which are provided on each piston valve in opposed pairs on each side of the opening of the piston valve.

6. A machine according to claim 5, in which the piston valve is provided with pairs of opposed seal openings on either side of the opening of the piston valve, and in which the longitudinal fluid seals are mounted in the seal openings.

7. A machine according to claim 6, in which the longitudinal fluid seals are biassed radially outwardly by leaf springs located in each seal openings of the piston valve.

8. A machine according to claim 5, in which each piston valve includes two pairs of encircling fluid seals, with each pair being provided on one side of the piston valve opening, and in which the longitudinal seals extend between the fluid seals of each pair.

9. A machine according to claim 4, in which each piston valve includes two pairs of encircling fluid seals, with each pair being provided on one side of the piston valve opening.

10. A machine according to claim 4, or claim 9, in which the means to prevent rotation of the piston valve comprises a key arrangement between the piston valve and the valve chamber.

11. A machine according to claim 10, in which the key arrangement is provided by a non-circular section of each piston valve which cooperates with a corresponding section of the valve chamber.

12. A machine according to claim 4, in which the opening of each piston valve is defined as an aperture region between two axially spaced, tubular cylindrical end portions of the piston valve.

13. A machine according to claim 4, or claim 9 which includes a pair of machine cylinders which are in communication with each other to define a common compression zone for the pistons of the machine cylinders.

14. A machine according to claim 13, in which the cylinders are aligned into an inverted V-arrangement.

15. A machine according to claim 13, in which the cylinders are at an angle of between 80 and 179 degrees to each other.

* * * * *